US010336495B2

(12) United States Patent
Hansen

(10) Patent No.: US 10,336,495 B2
(45) Date of Patent: Jul. 2, 2019

(54) CONTAINER COMPRISING A SINGLE-PIECE HEAD SECTION

(71) Applicant: KOCHER-PLASTIK MASCHINENBAU GMBH, Sulzbach-Laufen (DE)

(72) Inventor: Bernd Hansen, Sulzbach-Laufen (DE)

(73) Assignee: KOCHER-PLASTIK MASCHINENBAU GMBH, Sulzbach-Laufen (DE)

( * ) Notice: Subject to any disclaimer, the term of this patent is extended or adjusted under 35 U.S.C. 154(b) by 135 days.

(21) Appl. No.: 15/510,722

(22) PCT Filed: Sep. 10, 2015

(86) PCT No.: PCT/EP2015/001823
§ 371 (c)(1),
(2) Date: Mar. 13, 2017

(87) PCT Pub. No.: WO2016/066238
PCT Pub. Date: May 6, 2016

(65) Prior Publication Data

US 2017/0275043 A1 Sep. 28, 2017

(30) Foreign Application Priority Data

Oct. 31, 2014 (DE) ..... 10 2014 016 192
Nov. 26, 2014 (CN) ..... 2014 2 0720014 U

(51) Int. Cl.
*B65D 1/02* (2006.01)
*B29C 49/00* (2006.01)

(52) U.S. Cl.
CPC ..... *B65D 1/0238* (2013.01); *B65D 1/0246* (2013.01); *B65D 1/0276* (2013.01); *B29C 49/00* (2013.01)

(58) Field of Classification Search
CPC .. B65D 1/0238; B65D 1/0276; B65D 1/0246; B29C 49/00
(Continued)

(56) References Cited

U.S. PATENT DOCUMENTS 4,176,755 A * 12/1979 Winchell ..... B65D 1/0238 215/48
4,467,930 A 8/1984 Schnell et al.
(Continued)

FOREIGN PATENT DOCUMENTS

EP 0 228 662 7/1987
EP 2 269 558 1/2011

OTHER PUBLICATIONS

International Search Report (ISR) dated Nov. 13, 2015 in International (PCT) Application No. PCT/EP2015/001823.

*Primary Examiner* — James N Smalley
(74) *Attorney, Agent, or Firm* — Wenderoth, Lind & Ponack, L.L.P.

(57) ABSTRACT

A container of a plastic material is produced using a blow-fill-seal method, and has a container body (1) for receiving a fluid as well as a neck section (5) connected to the container body (1). At the container free end, a dispensing opening (13) for fluid is sealed via a separating region (15, 19) with a head section (17) that can be removed from the neck section (5) by actuating a movable sleeve section (35). By releasing the separating region (15, 19), the dispensing opening (13) is exposed. From the unactuated state to the actuated state in which the separating region (15, 19) is released, the sleeve section (35) is guided so as to be at least partially in contact with a guide path (23) that is part of the removable head section (17).

20 Claims, 3 Drawing Sheets

(58) Field of Classification Search
USPC ..... 215/48
See application file for complete search history.

(56) References Cited

U.S. PATENT DOCUMENTS 4,478,342 A 10/1984 Slater et al.
4,485,064 A * 11/1984 Laurin ..... A61J 1/1443
215/317
4,494,663 A * 1/1985 Bertaud ..... B65D 41/3495
215/232
4,662,529 A * 5/1987 Moore ..... B65D 1/0238
215/48
4,721,215 A * 1/1988 Bertaud ..... B65D 1/0238
215/253

* cited by examiner

CONTAINER COMPRISING A SINGLE-PIECE HEAD SECTION

FIELD OF THE INVENTION

The invention relates to a container, in particular of a plastic material, produced using a blow-fill-seal method, and having a container body for receiving a fluid as well as a neck section connected to the container body. On the container free end, a dispensing opening for the fluid is sealed, via a separating region, with a head section that can be removed from the neck section by actuating a movable sleeve section. By releasing the separating region, the dispensing opening is exposed.

BACKGROUND OF THE INVENTION

Plastic containers that are produced using a blow-fill-seal method (BFS method) such as the one described in EP 2 269 558 A1 and also known in the industry by the name "Bottelpack® System" are used for foods and beverages as well as in the medical field with great advantage for packaging pharmaceuticals, diagnostic materials, enteral nutrition, and medicinal products such as flushing and dialysis solutions, and the like. The embodiment of the container neck section and of the head section that seals the access opening on the neck section as a single piece in the blow mold method has the advantage that the container contents only contact a polymer that forms the container material, which polymer is typically a plastic such as LDPE, HDPE, or PP. The low germ count/sterility of the container contents can then be ensured in containers produced and filled in this manner.

The separating region, via which the head section is formed on the neck section, is configured in such containers as a predetermined breaking point at which the head section can be released from the neck section for an extraction process. In order to enable the user to release the separation region reliably and conveniently, U.S. Pat. No. 4,176,755 has already disclosed a container of the aforementioned type, which has, as an opening or tearing aid, an actuation element in the form of a sleeve section that the user can actuate. In its standby position, the sleeve section surrounds the neck section and at least parts of the head section in the nature of an outer ring. The user can actuate the outer ring. In an actuated state, the outer ring releases the separating region by tearing open the predetermined breaking point.

SUMMARY OF THE INVENTION

On the basis of this prior art, the invention addresses the problem of further improving a container of this type in terms of particularly good performance characteristics.

According to the invention, this problem is basically solved by a container having, as an essential unique feature of the invention, from the unactuated state to the actuated state in which the separating region is released, a sleeve section guided so as to be at least partially in contact with a guide path, which is a part of the removable head section. As a result of this structure, the sleeve section is aligned coaxially to the head section such that compared to the aforementioned prior art, a more uniform load is applied to the separating region during the release. A reliable tearing open process is then ensured over the entire circumference of the access opening, even for relatively large diameter access openings with correspondingly wide separating regions.

In advantageous fashion, for actuating the sleeve section provision can be made of a male thread arranged on the neck section and of a female thread on the sleeve section that can be brought into engagement with the male thread. By screwing the sleeve section, the separating region can be released and the dispensing opening exposed. By a screwing process, it is possible to generate, in a particularly convenient manner, relatively strong actuation forces so that the container according to the invention is particularly convenient and effortless for the user to manipulate.

With particular advantage, when the sleeve section is screwed on, the separating region can be released such that a contact shoulder of the sleeve section in contact with the head section entrains the head section to release the separating area.

In particularly advantageous exemplary embodiments, the sleeve section has flexible contact fingers on its free end face. The contact fingers engage in an underhand grip with a projection on the head section as the sleeve section is screwed on. The sleeve section can be brought, by partially screwing it on, into a standby position in which the sleeve section is secured on, but can be still twistable in relation to the head section by the contact fingers clicking in place. After carrying out an extraction process by screwing on the sleeve section further, during a subsequent unscrewing of the sleeve section the contact fingers entrain the head section detached from the separating region. The head section is then undetachably secured to the sleeve section after the sleeve section is removed.

In order to give the user the option of carrying out an extraction process by screwing the sleeve section on as well as by unscrewing it, the arrangement can be made such that by unscrewing the sleeve section with the separating region not released, the contact fingers, which are engaged in an underhand grip with the projection of the head section, entrain the head section and release the separating region.

With particular advantage, the guide path for the actuation movements of the sleeve section can be formed on the outside of a ring collar that surrounds the head section and that extends between the separating region and an annular groove. The annular groove forms the space on the head section for receiving the contact fingers. A partition wall of the annular groove is then available as an extensive ledge for supporting the contact fingers. The outer diameter of the ring collar can correspond to the inner diameter of the neck section in the region of its male thread. The ring collar can have an axial extension, the length of which corresponds to the axial length of the annular groove, measured over its smallest diameter size.

In particularly advantageous exemplary embodiments, with the contact fingers of the sleeve section engaged in an underhand grip with the projection of the head section, an allocatable surface of the sleeve section is in full contact with the guide path. The contact shoulder of the sleeve section overlaps the end of the ring collar at the upper end of the guide path. The contact surface of the sleeve section then fully encompasses the ring collar of the head section such that when the actuation or tear-off force is transmitted via the contact shoulder, a counter-bearing is formed that prevents a radial deviation of the separation joint region of the head section under the effect of the actuation force to ensure a particularly reliable tearing off process.

For a particularly reliable transfer of the separation or tear-off force, a reinforcing rib projecting inwardly toward and connecting to the separating region can be present on the inner circumferential side of the ring collar. In cross section this reinforcing rib, at least when the sleeve section is unactuated, can form a wedge shape of which the longest cross leg in the direction of the neck section ends at the separating region and is arranged spaced parallel apart from another boundary line closing the reinforcing rib.

For a corresponding reinforcement on the opening edge of the neck section, the dispensing opening of the neck section can be bordered by an annular bulge, which protrudes above the separating region toward the unactuated sleeve section and abuts on the separating region with its largest cross sectional dimension.

The arrangement can furthermore be made such that the outer contour of the sleeve section is provided with a bevel toward the run-out of the contact fingers, which bevel is adapted to an inclined position of the contact fingers. In the starting position in which the neck section is only partially screwed on, i.e. before reaching the standby position, the bevel of the sleeve section forms a continuous transition from the contact fingers to the upper surface of the head section that is essentially smooth and that is optically and haptically appealing.

Other objects, advantages and salient features of the present invention will become apparent from the following detailed description, which, taken in conjunction with the drawings, discloses a preferred embodiment of the present invention.

BRIEF DESCRIPTION OF THE DRAWINGS

Referring to the drawings that form a part of this disclosure.

DETAILED DESCRIPTION OF THE INVENTION

Figure 2:
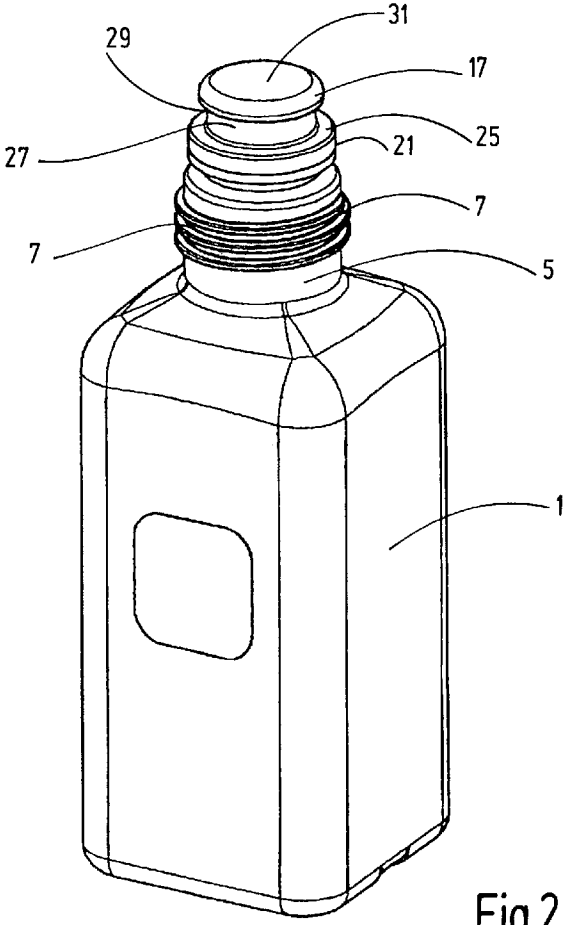
FIG. 2 is a perspective view of the container of FIG. 1, with the actuation element omitted.
Figure 1:
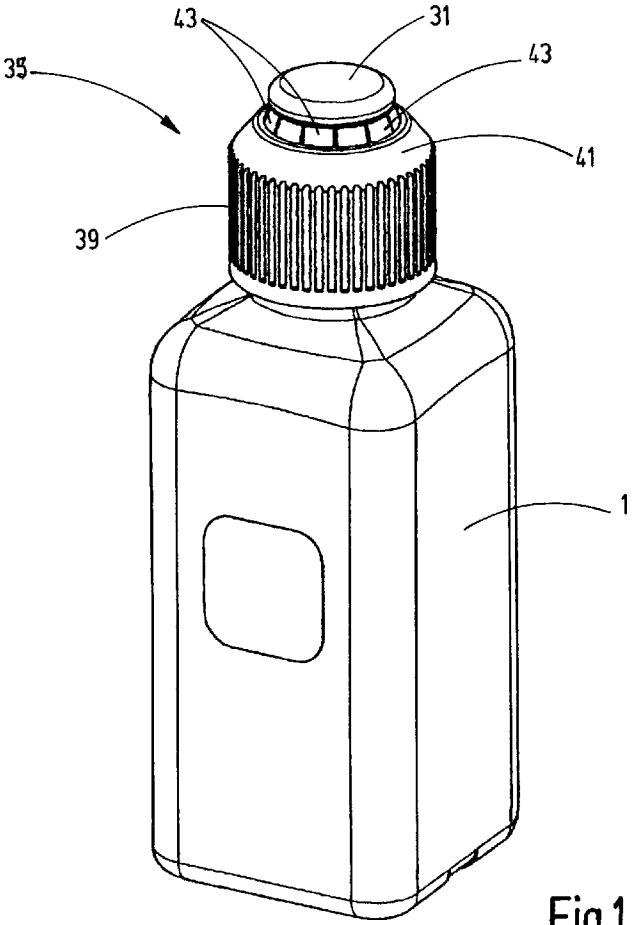
FIG. 1 is a perspective view, illustrated in approximately the natural size of a practical embodiment, of a container according to an exemplary embodiment of the invention, with the opening-actuation element in the standby position.

As can be discerned from FIGS. 1 and 2, this exemplary embodiment of the container of the invention has a main container section 1 in the form of a plastic bottle. With reference to a central main axis 3, the main container section 1 possesses a square cross section with rounded corner regions and is designed with a 150 ml fill volume for receiving a fluid. As FIG. 2 most clearly shows, a neck section 5 coaxial to the axis 3 is molded onto the upper surface of the main section 1. The diameter of neck section 5 corresponds to roughly half the width of the main section 1. The outside of the neck section 5 is provided with a male thread 7 on approximately half of its length. As FIGS. 3-5 most clearly show, in its upper region the neck section 5 has, at a short axial distance from the uppermost winding of the male thread 7, an annular surface 9 that extends radially inwards, is upwardly inclined toward the axis 3, and transitions at the upper end into an end surface 11 extending upwards and diverging outwards from the axis 3. The end edge of end surface 11 surrounds the access opening 13 of the neck section 5. An edge bulge 15 that protrudes slightly outwards is then formed on the edge of the access opening 13. As a sealing section for the access opening 13, a head section 17 is molded on the edge of the access opening 13 as an integral part of the neck section 5. The edge bulge 15 and a reinforcing rib 19, which is located on the front-facing end of the head section 17, jointly form a separating region in which the junction point between the edge bulge 15 and the reinforcing rib 19 forms a predetermined breaking point. At the breaking point, head section 17 can be detached from the neck section 5 to expose the access opening 13 for an extraction process. The reinforcing rib 19 is present as a wedge-shaped, radially inward-extending projection on the end of a ring collar 21. The outside of ring collar 21 forms an outer cylinder surface 23, on the upper end of which is formed a step surface 25 that borders the radial length of the outer cylinder surface 23 and that extends radially inwards into an adjoining annular groove 27 of the head section 17. The upper end of the annular groove 27 is delimited by a flange-shaped radially outward-extending projection 29, which transitions into the upper end surface 31 of the head section 17.

As a tearing-off aid for releasing the head section 17 at the predetermined breaking point formed at the separating region 15, 19, a sleeve section 35 can be screwed onto the male thread 7 of the neck section 5. The sleeve section 35 has a female thread 37 in a circular cylindrical longitudinal section thereof and a longitudinal riffle 39 on the outside of that section. A sloping surface 41 adjoins the circumferential section having the riffle 39, which sloping surface 41 reduces the outer diameter of the neck section 35 toward the upper free end face. Starting from the sloping surface 41, a ring of contact fingers 43 extends to the upper end face. The contact fingers 43 are inclined toward the axis 3. In the region between the sloping surface 41 and the contact fingers 43, the neck section 43 forms an inside contact shoulder 45 in the form of an annular surface lying in a radial plane.

Figure 3:
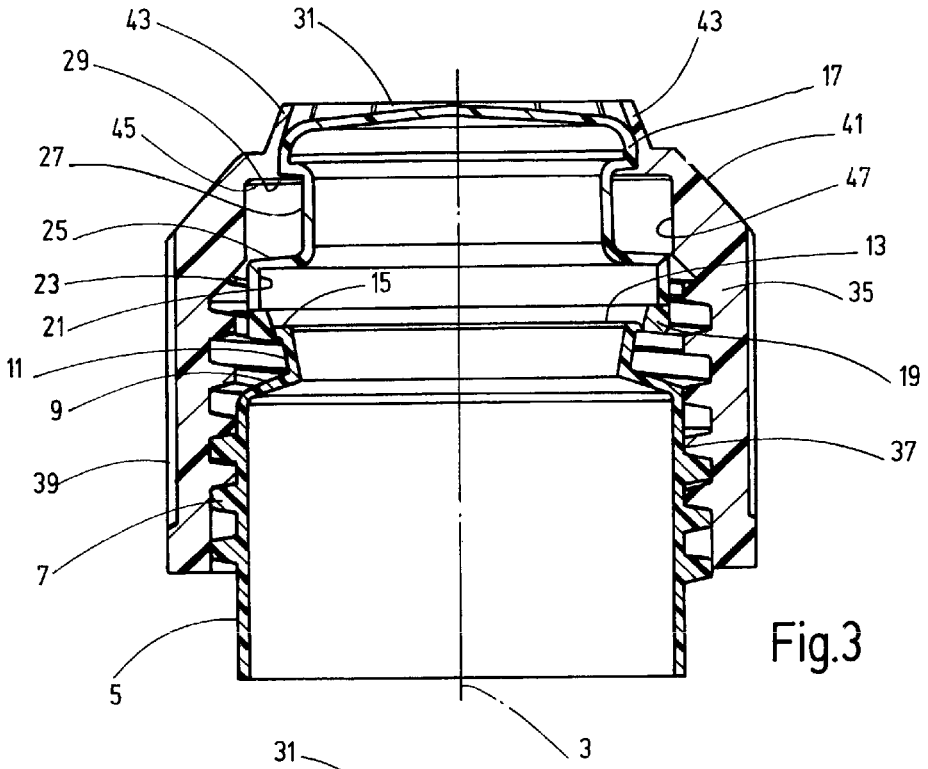
FIG. 3 is an enlarged partial side view in section, drawn on a larger scale, of just the neck section and head section region of the container of FIG. 1, in which the actuation element is shown in a partially screwed-on starting position.

FIG. 3 shows the sleeve section 35 in a starting position in which it is only partially screwed on, in which the contact shoulder 45 is located at a distance from the step surface 25 on the ring collar 21 and the contact fingers 43 extend to the upper end surface 31 of the head section 17.

Figure 4:
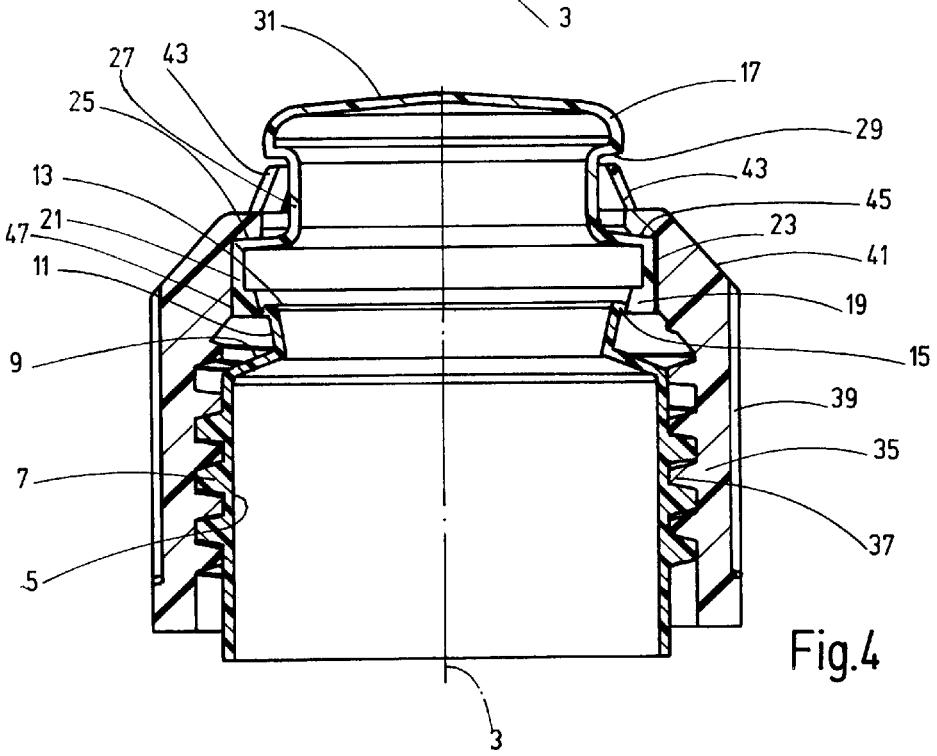
FIG. 4 is an enlarged, partial side view in section of the container of FIG. 1, with the actuation element illustrated in the standby position.

FIG. 4 shows the state in which the sleeve section 35, after being screwed on further, is in a standby position in which the contact fingers 43 are snapped into the annular groove 27 of the head section 17 beneath the projection 29. The sleeve section 35 has moved sufficiently far downwards such that a circular cylindrical inner contact surface 47 located in the region of the sloping surface 41 on the sleeve section 35 is in full contact with the outer cylinder surface 23 of the ring collar 21. The outer cylinder surface 23 then forms a guide path for the sleeve section 35, on which the sleeve section 35 is guided in its axial movement as it is being screwed on.

Figure 5:
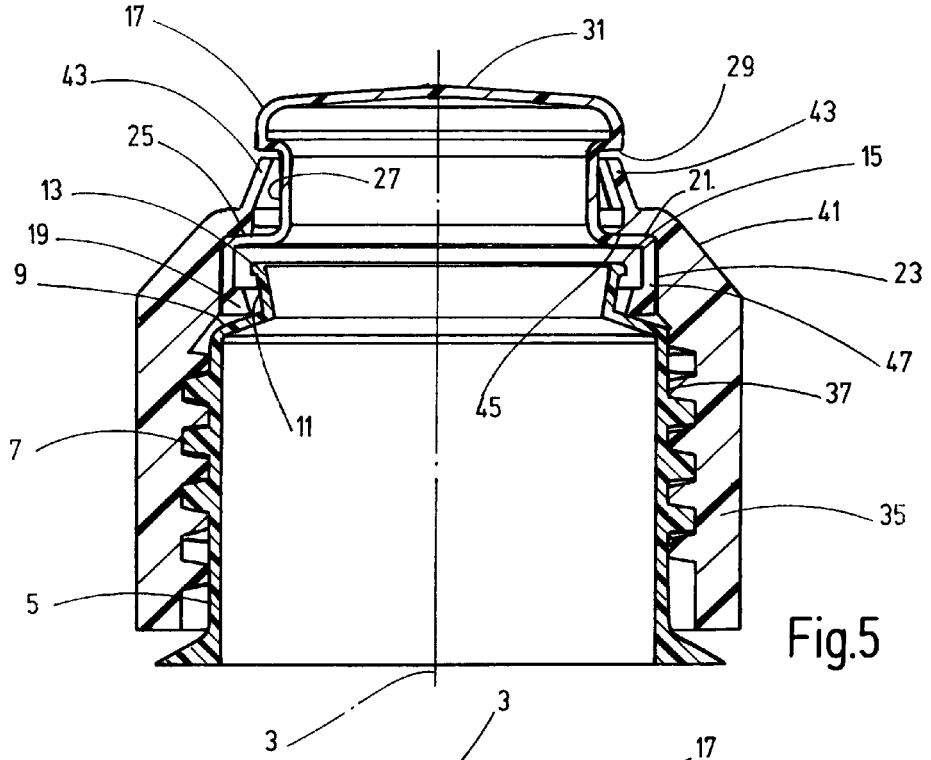
FIG. 5 is an enlarged side view in section of the container of FIG. 1, with the actuation element in the screwed-on position after the opening of the container.

As the sleeve section 35 is being screwed on further from the standby position shown in FIG. 4 to the opening position shown in FIG. 5, in which the contact surface 47 of the sleeve section 35 slides on the guide wall formed by the outer cylinder surface 23 of the ring collar 21, the contact shoulder 45 of the sleeve section 35, which contact shoulder 45 overlaps the step surface 25 of the ring collar 21, entrains the head section 17 such that the predetermined breaking point tears at the separating region 15, 17, and the access opening 13 is exposed (see FIG. 5, in which this state is illustrated).

Figure 6:
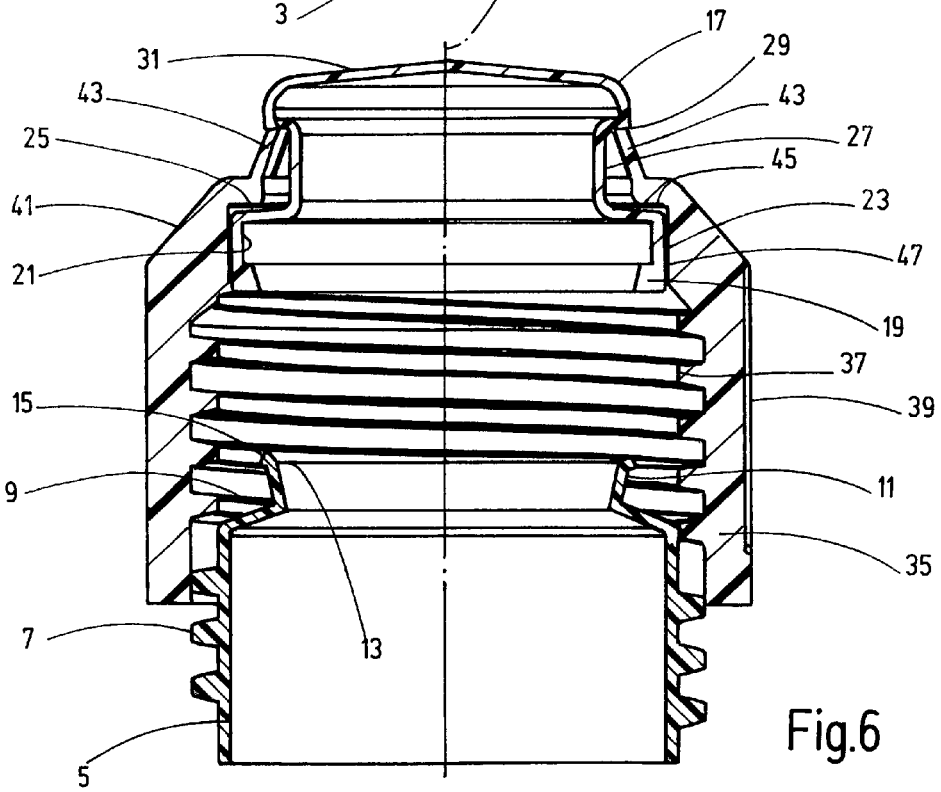
FIG. 6 is an enlarged partial side view in section of the container of FIG. 1, with the actuation element in a position in which it is partially unscrewed from the opened container.

FIG. 6 shows the sleeve section 35 in a position in which the sleeve section 35 is partially unscrewed from the position shown in FIG. 5, after the opening or tearing-off process. During this axial movement, the head section 17 is entrained by the underhand grip of the contact fingers 43 on the projection 29 such that, when the sleeve section 35 is completely unscrewed, the head section 17 is removed together with the sleeve section 35 and is then undetachably secured to the removed sleeve section 35. Should a subsequent closing of the bottle be desired, the head section 17 is then available without any intervention on the user's part for being screwed back on together with the sleeve section 35. Because the inner contact surface 47 of the sleeve section 35 is in full contact with the outer cylinder surface 23 of the ring collar 21 that forms the guide path, a counter-bearing can be formed for the ring collar 21, and the access opening 13 can be resealed by tightening the screw connection and by the reinforcing rib 19 contacting the annular surface 9 of the neck section 5 (see FIG. 5).

If the contact fingers 43 are configured as sufficiently rigid, the opening process can also be carried out by unscrewing the sleeve section 35 from the standby position (FIG. 4). During the upwards-running axial movement, the contact fingers 43 in underhand grip with the projection 29 entrain the head section 17 for an upwards-running shearing movement.

While one embodiment has been chosen to illustrate the invention, it will be understood by those skilled in the art that various changes and modifications can be made therein without departing from the scope of the invention as defined in the claims.

The invention claimed is:

1. A container, comprising:

a container body capable of receiving a fluid;

a neck section being connected to said container body and having a dispensing opening at a free end of said neck section capable of dispensing the fluid from said container body;

a head section being removably connected to said neck section by a separating region and releasably sealing said dispensing opening closed; and a movable sleeve section being coupled to said neck section and being actuatable to remove said head section from said neck section by releasing said separating region to open said dispensing opening, said movable sleeve section being movable from an unactuated state in which said dispensing opening is closed to an actuated state in which said separating region is released and being guided by being at least partially in contact with a guide path that is part of said head section, said guide path being formed on an outside of a ring collar surrounding said head section and extending between said separating region and an annular groove on said head section, said ring collar having an axial extension with a length of said annular groove measured on a smallest diameter size thereof.

2. A container according to claim 1 wherein said neck section comprises a male thread and said sleeve section comprises a female thread engaging said male thread to actuate said sleeve section, screwing said male and female threads causing said sleeve section to release said separating region to open said dispensing opening.

3. A container according to claim 2 wherein said sleeve section comprises a contact shoulder with said head section entraining said head section to release the separating region.

4. A container according to claim 2 wherein said sleeve section has flexible contact fingers on a free end face of said sleeve section, said contact fingers engaging a projection on said head section in an underhand manner and entraining said head section as said sleeve section is unscrewed with said separating region being released.

5. A container according to claim 2 wherein said sleeve section has flexible contact fingers on a free end face of said sleeve section, said contact fingers engaging a projection on said head section in an underhand manner and entraining said head section as said sleeve section is being unscrewed with said separating region being unreleased.

6. A container according to claim 1 wherein said annular groove forms a space in which flexible contact fingers on a free end of said sleeve section are receivable.

7. A container according to claim 3 wherein said sleeve section comprises flexible contact fingers on a free end of said sleeve section, said contact fingers engaging a projection on said head section in an underhand manner;

an allocatable contact surface of said sleeve section is in full contact with said guide path of said ring collar; and said contact shoulder of said sleeve section overlaps an end of said ring collar at an upper end of said guide path.

8. A container according to claim 1 wherein a reinforcing rib projects inwardly and connects to said separating region on an inner circumferential side of said ring collar.

9. A container according to claim 8 wherein with said sleeve section unactuated, said reinforcing rib has a wedge-shape in cross section, with a longest leg of said wedge-shape in a direction of said neck section ending at said separating region and being parallel and spaced apart from a boundary line closing said reinforcing rib.

10. A container according to claim 1 wherein said dispensing opening of said neck section is delimited by an annular bulge projecting over said separating region toward said sleeve section in the unactuated state and bordering said separating region with a largest cross-sectional diameter dimension thereof.

11. A container according to claim 1 wherein said sleeve section comprises an outer contour provided with a bevel in a direction of flexible contact fingers on a free end of said sleeve section, said bevel being adapted to an inclined position of said contact fingers.

12. A container, comprising:

a container body capable of receiving a fluid;

a neck section being connected to said container body and having a dispensing opening at a free end of said neck section capable of dispensing the fluid from said container body;

a head section being removably connected to said neck section by a separating region and releasably sealing said dispensing opening closed;

a movable sleeve section being coupled to said neck section and being actuatable to remove said head section from said neck section by releasing said separating region to open said dispensing opening, said movable sleeve section being movable from an unactuated state in which said dispensing opening is closed to an actuated state in which said separating region is released and being guided by being at least partially in contact with a guide path that is part of said head section, said guide path being formed on an outside of a ring collar surrounding said head section; and a reinforcing rib projecting inwardly and being connected to said separating region on an inner circumferential side of said ring collar.

13. A container according to claim 12 wherein with said sleeve section unactuated, said reinforcing rib has a wedge-shape in cross section, with a longest leg of said wedge-shape in a direction of said neck section ending at said separating region and being parallel and spaced apart from a boundary line closing said reinforcing rib.

14. A container, comprising:

a container body capable of receiving a fluid;

a neck section being connected to said container body and having a dispensing opening at a free end of said neck section capable of dispensing the fluid from said container body;

a head section being removably connected to said neck section by a separating region and releasably sealing said dispensing opening closed; and a movable sleeve section being coupled to said neck section and being actuatable to remove said head section from said neck section by releasing said separating region to open said dispensing opening, said movable sleeve section being movable from an unactuated state in which said dispensing opening is closed to an actuated state in which said separating region is released and being guided by being at least partially in contact with a guide path that is part of said head section, said dispensing opening of said neck section being delimited by an annular bulge projecting over said separating region toward said sleeve section in the unactuated state and bordering said separating region with a largest cross-sectional diameter dimension thereof.

15. A container, comprising:

a container body capable of receiving a fluid;

a neck section being connected to said container body and having a dispensing opening at a free end of said neck section capable of dispensing the fluid from said container body;

a head section being removably connected to said neck section by a separating region and releasably sealing said dispensing opening closed; and a movable sleeve section being coupled to said neck section and being actuatable to remove said head section from said neck section by releasing said separating region to open said dispensing opening, said movable sleeve section being movable from an unactuated state in which said dispensing opening is closed to an actuated state in which said separating region is released and being guided by being at least partially in contact with a guide path that is part of said head section, said guide path being formed on an outside of a ring collar surrounding said head section and extending between said separating region and an annular groove on said head section, said annular groove forming a space;

flexible contact fingers on a free end face of said sleeve section, said contact fingers being received in said space formed by said annular groove, engaging a projection on said head section in an underhand manner and entraining said head section as said sleeve section is unscrewed with said separating region being released; and a reinforcing rib projecting inwardly and being connected to said separating region on an inner circumferential side of said ring collar.

16. A container according to claim 15 wherein said neck section comprises a male thread and said sleeve section comprises a female thread engaging said male thread to actuate said sleeve section, screwing said male and female threads causing said sleeve section to release said separating region to open said dispensing opening.

17. A container according to claim 16 wherein said sleeve section comprises a contact shoulder with said head section entraining said head section to release the separating region.

18. A container according to claim 16 wherein said contact fingers engage said projection on said head section in an underhand manner and entrain said head section as said sleeve section is being unscrewed with said separating region being unreleased.

19. A container according to claim 16 wherein said ring collar has an outer diameter corresponding to an inner diameter of said neck section in a region of said male thread.

20. A container according to claim 15 wherein an allocatable contact surface of said sleeve section is in full contact with said guide path of said ring collar; and said contact shoulder of said sleeve section overlaps an end of said ring collar at an upper end of said guide path.

* * * * *